US006632781B2

(12) United States Patent
Harrison et al.

(10) Patent No.: US 6,632,781 B2
(45) **Date of Patent: *Oct. 14, 2003**

(54) LUBRICANT COMPOSITION COMPRISING ALKALI METAL BORATE DISPERSED IN A POLYALKYLENE SUCCINIC ANHYDRIDE AND A METAL SALT OF A POLYISOBUTENYL SULFONATE

(75) Inventors: James J. Harrison, Novato, CA (US); Kenneth D. Nelson, Clear Lake, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/967,049

(22) Filed: Sep. 28, 2001

(65) Prior Publication Data

US 2003/0073587 A1 Apr. 17, 2003

(51) Int. Cl.[7] ..... C01M 125/26; C01M 141/08

(52) U.S. Cl. ..... 508/158; 508/156; 508/306; 508/390; 508/413

(58) Field of Search ..... 508/156, 158, 508/306, 390

(56) References Cited

U.S. PATENT DOCUMENTS

| | | | | |
|---|---|---|---|---|
| 3,313,727 A | | 4/1967 | Peeler | 508/156 |
| 3,489,619 A | | 1/1970 | Brewster | 148/637 |
| 3,819,521 A | | 6/1974 | Sims | 508/160 |
| 3,853,772 A | | 12/1974 | Adams | 508/156 |
| 3,912,643 A | | 10/1975 | Adams | 508/156 |
| 3,997,454 A | | 12/1976 | Adams | 508/156 |
| 4,089,790 A | | 5/1978 | Adams | 508/156 |
| 4,163,729 A | | 8/1979 | Adams | 508/156 |
| 4,253,977 A | * | 3/1981 | O'Halloran | 508/270 |
| 4,263,155 A | | 4/1981 | Frost | 508/156 |
| 4,401,580 A | | 8/1983 | Frost | 508/160 |
| 4,472,288 A | | 9/1984 | Frost, Jr. | 508/159 |
| 4,584,873 A | | 4/1986 | Ongaro | 73/146 |
| 4,778,614 A | * | 10/1988 | Rawlinson et al. | 508/195 |
| 5,389,271 A | * | 2/1995 | Lundberg et al. | 508/390 |
| 5,523,417 A | * | 6/1996 | Blackborow et al. | 549/233 |
| 5,972,852 A | * | 10/1999 | Robson | 508/306 |
| 6,410,491 B1 | * | 6/2002 | Harrison et al. | 508/391 |
| 6,534,450 B1 | * | 3/2003 | Harrison et al. | 508/158 |

FOREIGN PATENT DOCUMENTS

| | | |
|---|---|---|
| EP | 0976813 A1 | 2/2000 |
| WO | WO 8803943 | 6/1988 |

* cited by examiner

*Primary Examiner*—Ellen M. McAvoy
(74) *Attorney, Agent, or Firm*—Joseph P. Foley; Claude J. Caroli

(57) ABSTRACT

Disclosed are lubricant compositions comprising a dispersed hydrated alkali metal borate, a polyalkylene succinic dispersant selected from a polyalkylene succinic anhydride, a mixture of polyalkylene succinic anhydrides or derivatives thereof; and a metal salt of a polyisobutenyl sulfonate. Also disclosed are methods for improving the water tolerance of a lubricant composition and methods for preparing such lubricants comprising a dispersed hydrated alkali metal borate and a dispersant mixture.

19 Claims, No Drawings

LUBRICANT COMPOSITION COMPRISING ALKALI METAL BORATE DISPERSED IN A POLYALKYLENE SUCCINIC ANHYDRIDE AND A METAL SALT OF A POLYISOBUTENYL SULFONATE

BACKGROUND OF THE INVENTION

FIELD OF THE INVENTION

This invention is directed, in part, to novel lubricant compositions. These compositions comprise an alkali metal borate; a polyalkylene succinic anhydride including mixtures and/or derivatives thereof; and a metal salt of a polyisobutenyl sulfonate. Surprisingly, these compositions have improved compatibility, extreme pressure properties and/or water tolerance over compositions comprising other metal sulfonates.

This invention is also directed, in part, to methods for improving the water tolerance of a lubricant composition comprising an alkali metal borate. Such methods employ compositions comprising an alkali metal borate; and a polyalkylene succinic anhydride including mixtures and/or derivatives thereof; and a metal salt of a polyisobutenyl sulfonate.

REFERENCES

The following references are cited in this application as superscript numbers:

[1] Peeler, U.S. Pat. No. 3,313,727, Alkali Metal Borate EP. Lubricants, issued Apr. 11, 1967

[2] Adams, U.S. Pat. No. 3,912,643, Lubricant Containing Neutralized Alkali Metal Borates, issued Oct. 14, 1975

[3] Sims, U.S. Pat. No. 3,819,521, Lubricant Containing Dispersed Borate and a Polyol, issued Jun. 25, 1974

[4] Adams, U.S. Pat. No. 3,853,772, Lubricant Containing Alkali Metal Borate Dispersed with a Mixture of Dispersants, issued Dec. 10, 1974

[5] Adams, U.S. Pat. No. 3,997,454, Lubricant Containing Potassium Borate, issued Dec. 14, 1976

[6] Adams, U.S. Pat. No. 4,089,790, Synergistic Combinations of Hydrated Potassium Borate, Antiwear Agents, and Organic Sulfide Antioxidants, issued May 16, 1978

[7] Adams, U.S. Pat. No. 4,163,729, Synergistic Combinations of Hydrated Potassium Borate, Antiwear Agents, and Organic Sulfide Antioxidants, issued Aug. 7, 1979

[8] Frost, U.S. Pat. No. 4,263,155, Lubricant Composition Containing an Alkali Metal Borate and a Sulfur-Containing Polyhydroxy Compound, U.S. Pat. No. 5,461,184, issued Oct. 24, 1995

[9] Frost, U.S. Pat. No. 4,401,580, Lubricant Composition Containing an Alkali Metal Borate and an Ester-Polyol Compound, issued Aug. 30, 1983

[10] Frost, U.S. Pat. No. 4,472,288, Lubricant Composition Containing an Alkali Metal Borate and an Oil-Soluble Amine Salt of a Phosphorus Compound, issued Sep. 18, 1984

[11] Clark, U.S. Pat. No. 4,584,873, Automotive Friction Reducing Composition, issued Aug. 13, 1985

[12] Brewster, U.S. Pat. No. 3,489,619, Heat Transfer and Quench Oil, issued Jan. 13, 1970

All of the above references are herein incorporated by reference in their entirety to the same extent as if each individual publication or patent was specifically and individually indicated to be incorporated by reference in its entirety.

STATE OF THE ART

High load conditions often occur in gear sets such as those used in automobile transmissions and differentials, pneumatic tools, gas compressors, centrifuges, high-pressure hydraulic systems, metal workings and similar devices as well as in many types of bearings. When employed in such environments, it is conventional to add an extreme-pressure agent to the lubricant composition and, in this regard, alkali metal borates are well known extreme-pressure agents for such compositions.[1-12]

Because the alkali metal borate is insoluble in lubricant oil media, it is conventional to include a dispersant/detergent in such compositions in order to facilitate the formation of a homogenous dispersion. Examples of dispersant/detergents include ionic surface-active agents such as metal salts of oil soluble acidic organic compounds, e.g., sulfonates, carboxylates and phenolates, as well as non-ionic surface-active agents such as alkenyl succinimides or other nitrogen containing dispersants.[1-4] It is also conventional to employ the alkali metal borate at particle sizes of less than 1 micron in order to facilitate the formation of the homogenous dispersion.[11]

The use of alkali metal borates in lubricant compositions is complicated by the presence of water in the environment where the composition is employed. Conventional preparation methods remove essentially all the water from the media[12]. However, when the presence of water exceeds a threshold concentration in the lubricant composition, the borate crystallizes out of the composition and forms hard granules. These granules cause severe noise in the lubricated systems and can severely damage the gears or bearings themselves as well as leading to seal leakage.[10] Further, borate lost by crystallization decreases the extreme pressure properties of the lubricant composition.

On the other hand, lubricant compositions employing alkali metal borates are often employed in environments where water is invariably present.

In view of the above, enhanced water tolerance of lubricant compositions comprising an alkali metal borate would be particularly beneficial.

SUMMARY OF THE INVENTION

This invention is directed to the novel and unexpected discovery that enhanced water tolerance and lubricant oil compatibility for alkali metal borates can be achieved by employing a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride and mixtures of one or more polyalkylene succinic anhydrides and one or more non-nitrogen containing derivatives of polyalkylene succinic anhydrides; and b) a metal salt of a polyisobutenyl sulfonate.

Accordingly, in one of its composition aspects, this invention is directed to a lubricant composition which comprises a base oil of lubricating viscosity, a dispersed hydrated alkali metal borate, and a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of the polyalkylene succinic anhydride; and b) a metal salt of a polyisobutenyl sulfonate.

Preferably, the dispersed hydrated alkali metal borate is present in a ratio of at least 2:1 relative to the dispersant mixture of polyalkylene succinic dispersant and polyisobutenyl sulfonate. More preferably, the ratio of dispersed hydrated alkali metal borate to dispersant mixture is from 2:1 up to 10:1. Most preferably the ratio is 5:2.

Preferably, the dispersed hydrated alkali metal borate is a dispersed hydrated sodium borate. Even more preferably the dispersed hydrated sodium borate and has a sodium to boron ratio of from about 1:2.75 to about 1:3.25.

In a particularly preferred embodiment, the dispersed hydrated alkali metal borate is a hydrated sodium metal borate having a hydroxyl:boron ratio (OH:B) of from about 0.8:1 to 1.6:1 (more preferably about 0.8:1 to 1:1) and a sodium to boron ratio of from about 1:2.75 to 1:3.25 and the polyalkylene succinic anhydride is a polyisobutenyl succinic anhydride.

Preferably, the hydrated alkali metal borate contains small amounts of a water soluble oxo anion. Only from 0.001 moles to 0.11 moles of water soluble oxo anion should be present per mole of boron. This water-soluble oxo anion can include nitrate, sulfate, carbonate, phosphate, pyrophosphate, silicate, aluminate, germanate, stannate, zincate, plumbate, titanate, molybdate, tungstate, vanadate, niobate, tantalate, uranates, or can include the isopolymolybdates and isopolytungstates, or the heteropolymolybdates and heteropolytungstates, or mixtures thereof.

Preferably, the polyalkylene succinic dispersant, is a dispersant selected from a polyalkylene succinic anhydride or a mixture of polyalkylene succinic anhydrides. More preferably, the polyalkylene succinic anhydride is a polyisobutenyl succinic anhydride. In one preferred embodiment, the polyalkylene succinic anhydride is a polyisobutenyl succinic anhydride having a number average molecular weight of at least 500, more preferably at least 900 and still more preferably from at least about 900 to about 3000.

In another preferred embodiment, a mixture of polyalkylene succinic anhydrides is employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 500 to below 1000 and the high molecular weight component has a number average molecular weight of from 1000 to about 3000. Still more preferably, both the low and high molecular weight components are polyisobutenyl succinic anhydrides.

Preferably the metal salt of the polyisobutenyl sulfonate can be an alkali metal or alkaline earth metal salt. More preferably, the metal salt of the polyisobutenyl sulfonate is a calcium salt. Even more preferably, the calcium polyisobutenyl sulfonate employed has a total base number (TBN) of from about 14–17 due to the presence of some $Ca(OH)_2$ in the composition.

The polyisobutene employed is of sufficient molecular weight to provide oil-solubility to the polyisobutenyl sulfonic acid or metal salt thereof. Suitably, polyisobutenes having a number average molecular weight of from at least about 200 are employed. Preferably, the polyisobutene has a number average molecular weight of from about 200 to about 3000; more preferably, from about 300 to 2000; still more preferably, from about 400 to 1200; and even more preferably from about 500 to 1100.

This invention is also directed to methods for enhancing the water tolerance of lubricant compositions comprising alkali metal borate. Accordingly, in one of its method aspects, this invention is directed to a method for enhancing the water tolerance of lubricant compositions comprising alkali metal borate which method comprises adding an anti-wear effective amount of an alkali metal borate to a base oil of lubricating viscosity in combination with a dispersant effective amount of a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of polyalkylene succinic anhydrides; and b) a metal salt of a polyisobutenyl sulfonate.

This invention is still further directed to methods for the preparation of such lubricant compositions. Accordingly, in another of its method aspects, this invention is directed to a method for preparing a lubricant composition comprising a base oil of lubricating viscosity, a dispersed hydrated alkali metal borate, and a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of polyalkylene succinic anhydrides; and b) a metal salt of a polyisobutenyl sulfonate which method comprises:

mixing, under agitation, (1) an aqueous solution of boric acid and alkali metal hydroxide, and (2) a diluent oil containing the polyalkylene succinic dispersant and the metal salt of a polyisobutenyl sulfonate; then heating the mixture to partially dehydrate the mixture.

DETAILED DESCRIPTION OF THE INVENTION

This invention is directed, in part, to novel lubricant compositions comprising a base oil of lubricating viscosity, dispersed hydrated alkali metal borate and a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of the polyalkylene succinic anhydride; and b) a metal salt of a polyisobutenyl sulfonate.

Each of these components in the claimed composition will be defined herein.

The Dispersed Hydrated Alkali Metal Borate

Hydrated alkali metal borates are well known in the art. Representative patents disclosing suitable borates and methods of manufacture include: U.S. Pat. Nos. 3,313,727; 3,819,521; 3,853,772; 3,912,643; 3,997,454; and 4,089,790.[1-6]

The hydrated alkali metal borates can be represented by the following formula:

$$M_2O.mB_2O_3.nH_2O$$

where M is sodium or potassium, m is a number preferably from 2.5 to 4.5 (both whole and fractional), and n is a number preferably from 1.0 to 4.8. Preferred hydrated alkali metal borates are hydrated potassium borates and more preferably the hydrated sodium borates because of their improved water tolerance. Most preferred are the hydrated sodium borates having a sodium-to-boron ratio of about 1:3. In another of its preferred embodiment, the hydrated borate particles generally have a mean particle size of less than 1 micron.

The hydrated alkali metal borates will generally comprise about 10 to 75 weight percent, preferably 25 to 50 weight percent, more preferably about 35 to 40 weight percent of the lubricant composition. (Unless otherwise stated, all percentages are in weight percent based on the total weight of the composition.)

The hydrated alkali metal borate dispersions have been found to be reactive in the presence of water. The presence of water has been found to alter the size, shape, and composition of the dispersed, amorphous borate particles to ultimately produce a number of crystalline borates which generally separate out from the oil phase to form deposits in the oil, and can damage the elastomer seals in various engine parts and cause leakage.

We have also found that sodium borates give better water tolerance and compatibility than potassium borates.

Preferably, the hydrated alkali metal borates contain small amounts of a water soluble oxo anion. Only from 0.001 moles to 0.11 moles of water soluble oxo anion should be present per mole of boron. This water-soluble oxo anion can include nitrate, sulfate, carbonate, phosphate, pyrophosphate, silicate, aluminate, germanate, stannate, zincate, plumbate, titanate, molybdate, tungstate, vanadate, niobate, tantalate, uranates, or can include the isopolymolybdates and isopolytungstates, or the heteropolymolybdates and heteropolytungstates, or mixtures thereof.

The presence of small amounts of water soluble oxo anions in the alkali metal borates is thought to improve the water tolerance of the alkali metal borates by disrupting the crystal structure of the hydrolysis products. This results in a lower tendency to form crystals or in a reduced rate of crystallization.

Preferred hydrated alkali metal borates include hydrated sodium borates particularly those characterized by a hydroxyl:boron ratio (OH:B) of from about 0.8:1 to 1.6: 1, preferably about 0.9:1 to 1.50: 1, and by a sodium to boron ratio of from about 1:2.75 to 1:3.25. Even more preferred hydrated sodium metal borates are those having a hydroxyl:boron ratio of from about 1.00:1 to 1.40:1 and a sodium to boron ratio of about 1:3.

In this regard, the term "hydroxyl:boron ratio" or "OH:B" refers to the number of hydroxyl groups attached to boron (moles of hydroxyl groups per mole of boron) in the dispersed hydrated alkali metal borate compositions as exemplified, for example, by the structure below. For the purposes of this application, the OH:B ratio of a hydrated sodium borate is calculated from the maximum infra-red, IR, absorbance between 3800 and 3250 $cm^{-1}$ corrected by subtracting the baseline which is taken to be the absorbance at 3900 $cm^{-1}$ of a 5.000% solution of the dispersed hydrated alkali metal borate in an oil of lubricating viscosity wherein all interfering absorbances due to other compounds or impurities have been subtracted. The remaining absorbance in this range corresponds to the hydroxyl groups of the dispersed sodium borate which is then converted to the OH:B ratio as follows:

$$OH:B=21.0A_{max}/\%B$$

where $A_{max}$ is the IR absorbance (peak height in the region of 3800 to 3250 $cm^{-1}$); and %B is the percent boron in the original (non-diluted) dispersed sodium borate sample.

The absorbance in this range, 3800 to 3250 $cm^{-1}$ corresponds to the hydroxyl groups of the sodium borate oligomer complex. If other additives are added to mask or interfere with the absorbance within this preferred range such groups will be subtracted from the IR spectra in the initial calculation of the OH:B measurement.

This absorbance is measured with a Nicolet 5DXB FTIR Spectrometer fitted with a DTGS detector and CsI beam splitter. The spectrometer has $CaF_2$ windows with 0.2 mm Teflon® spacer with small section cut out and a suitable cell holder. A spectrum of the sample is obtained using a 4 $cm^{-1}$ resolution.

These sodium metal borates, having a 1:3 ratio of sodium to boron, can generally be represented by the following theoretical formula:

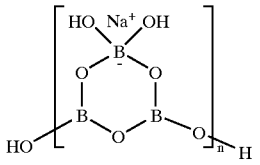

where n is a number preferably from 1.0 to 10.

Dispersed alkali metal borate compositions are generally prepared by forming, in deionized water, a solution of alkali metal hydroxide and boric acid optionally in the presence of a small amount of alkali metal carbonate. The solution is then added to a lubricant composition comprising an oil of lubricating viscosity, a dispersant mixture of the polyalkylene succinic dispersant and polyisobutenyl sulfonate as described above and any optional additives to be included therein (e.g., a detergent, 2,2'-thiodiethanol, and the like) to form an emulsion that is then dehydrated. Dehydration proceeds in three steps including an initial step of water removal that is initiated at a temperature of slightly over 100° C. This initial step is followed by a slow increase in temperature whereupon the emulsion changes from turbid to clear. In the final step, there is a rapid increase in temperature and the liquid once again becomes turbid.

Formation of the hydrated alkali metal borates described herein is achieved by stoichiometric selection of the appropriate amounts of alkali metal hydroxide and boron trioxide and control of the extent of dehydration such that the resulting product has the desired ratio of alkali metal to boron and the desired ratio of hydroxyl to boron.

The dehydration of the reaction mixture is carefully controlled (i.e. using a slower dehydration rate or employing a sweep gas, and the like) in order to avoid condensation of water on the walls of the reaction chamber. Condensation can result in water droplets in the lubricant composition which, in turn, can lead to undesired precipitate formation as described above. Such precipitate formation typically results in large particles that fall from suspension and have deleterious properties as previously noted. Accordingly, in a preferred embodiment of this invention, dehydration occurs over a period of from about 3 to 8 hours.

In a particularly preferred embodiment, the hydrated alkali metal borate particles generally have a mean particle size of less than 1 micron.

The Polyalkylene Succinic Dispersant

The polyalkylene succinic dispersant can be a polyalkylene succinic anhydride or a non-nitrogen containing derivative of the polyalkylene succinic anhydride and is preferably selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of the polyalkylene succinic anhydride. Non-nitrogen containing derivatives of polyalkylene succinic anhydrides preferably include, succinic acids, Group I and/or Group II mono- or di-metal salts of succinic acids, succinate esters formed by the reaction of a polyalkylene succinic anhydride, acid chloride, or other derivatives with an alcohol (e.g., HOR' where R' is alkyl of from 1 to 10) and the like.

The polyalkylene succinic anhydride is preferably a polyisobutenyl succinic anhydride. In one preferred embodiment, the polyalkylene succinic anhydride is a polyisobutenyl succinic anhydride having a number average molecular weight of at least 500, more preferably at least 900–3000 and still more preferably from at least about 900 to about 2300.

In another preferred embodiment, a mixture of polyalkylene succinic anhydrides is employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 500 to below 1000 and the high molecular weight component has a number average molecular weight of from 1000 to about 3000. Still more preferably, both the low and high molecular weight components are polyisobutenyl succinic anhydrides.

Preferably, the dispersed hydrated alkali metal borate is employed in a weight ratio of at least 2:1 relative to the polyalkylene succinic anhydride dispersant while being in the range of 2:1 to 10:1. In a preferred embodiment the weight ratio is at least 4:1. In a preferred embodiment, mixtures as defined above of the polyalkylene succinic anhydrides are employed.

The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents is incorporated herein by reference in their entirety.

The number average molecular weight of the polyalkylene tail in the polyalkylene succinic anhydride should be from about 300 to about 5000. This should be compatible with the previous ranges given before with the particular molecular weight depending on dispersant or mixture of dispersants to be employed. Preferably, the polyalkylene succinic anhydride component comprises from 2 to 40 weight percent, more preferably 10 to 15 weight percent of the weight of the lubricant composition.

Most preferable is the case where the polyalkylene succinic anhydride component is a polyisobutenyl succinic anhydride.

This invention is based, in part, on the discovery that the combination of a polyalkylene succinic dispersant and a metal salt of a polyisobutenyl sulfonate provides enhanced water tolerance and lubricating oil compatibility, when used in lubricating compositions comprising an alkali metal borate. It has also been found that a mixture of polyalkylene succinic anhydrides can be effectively employed. The mixture preferably comprises a low molecular weight polyalkylene succinic anhydride component and a high molecular weight polyalkylene succinic anhydride component. Alternatively, various molecular weight polyalkylene succinic anhydride components can be combined as a dispersant.

The Polyisobutenyl Sulfonate Dispersant

The metal salts of polyisobutenyl sulfonates used in the compositions of this invention can be highly overbased metal sulfonates or low overbased metal sulfonates. In addition, the sulfonic acids themselves can also be used. Overbased metal sulfonates are well known in the art. Highly overbased metal sulfonates typically have a total base number (TBN) of from about 250 to about 500, whereas low overbased metal sulfonates typically have a TBN of from about 0 to about 150. Both highly overbased metal sulfonates and low overbased metal sulfonates are well known in the art.

The term "metal sulfonate" is intended to encompass the salts of sulfonic acids derived from polyisobutene. Such polyalkenyl sulfonic acids are the subject of U.S. Pat. No. 6,410,491, which is incorporated herein by reference in its entirety. They can be obtained by treating polyisobutene with sulfur trioxide or a similar sulfonating agent such as acetyl sulfate and the like. The acids thus obtained are known as polyisobutene sulfonic acids and the salts as metal sulfonates. Suitable metals include the alkali metals (e.g., potassium, sodium, cesium), alkaline earth metals (e.g., magnesium, calcium, barium), of which calcium and barium are preferred.

The polyisobutene employed is of sufficient molecular weight to provide oil-solubility to the polyisobutenyl sulfonic acid or metal salt thereof. Suitably, polyisobutenes having a number average molecular weight of from at least about 200 are employed. Preferably, the polyisobutene has a numbered average molecular weight of from about 200 to about 3000; more preferably, from about 300 to 2000; still more preferably, from about 400 to 1200; and even more preferably from about 500 to 1100.

Suitable polyisobutenes are commercially available or can be prepared by art recognized techniques such as those disclosed in U.S. Pat. No. 4,605,808 to Samson, issued Aug. 12, 1986, which is incorporated by reference in its entirety.

Preferably, the polyisobutenyl sulfonates are derived from high methyl-vinylidene isomers and/or 1,1-dialkyl isomer, preferably a 1,1-dimethyl isomer. More preferably the polyisobutene sulfonates are high methylvinylidene polyisobutenyl sulfonates or a mixture of such.

Preferably, the polyisobutenyl sulfonate is a low overbased calcium polyisobutenyl sulfonate having a TBN of from about 14–17 and comprises from 0.5 to 20 weight percent, more preferably 2 to 10 weight percent of the lubricant composition.

In one preferred embodiment, the ratio of polyisobutenyl sulfonate dispersant to the hydrated alkali metal borate employed in the composition is from about 0.05:1 to 1:1 and more preferably about 0.11:1.

In another preferred embodiment, the ratio of the polyalkylene succinic dispersant to the polyisobutenyl sulfonate used in the dispersant mixture is from about 4:1 and more preferably from about 2.6:1.

The Oil of Lubricating Viscosity

The lubricating oil to which the borates and the dispersant mixture are added can be any hydrocarbon-based lubricating oil or a synthetic base oil stock. The hydrocarbon-based lubricating oils may be derived from synthetic or natural sources and may be paraffinic, naphthetic or asphaltenic base, or mixtures thereof. The diluent oil can be natural or synthetic, and can be different viscosity grades.

The lubricating oil comprises from 30 to 70 weight percent, more preferably from 45 to 55 weight percent of the lubricant composition.

Formulations

The dispersed hydrated alkali metal borate compositions of the present invention (as described herein above) are generally blended to form additive packages comprising such dispersed hydrated alkali metal borate compositions. These additive packages typically comprise from about 10 to 75 weight percent of the dispersed hydrated alkali metal borate composition described above and from about 90 to 15 weight percent of one or more of conventional additives selected from the group consisting of ashless dispersants (0–5%), detergents (0–2%), sulfurized hydrocarbons (0–30%), dialkyl hydrogen phosphates (0–10%), zinc dithiophosphates (0–20%), dialkyl hydrogen phosphates (0–10%), pentaerythritol monooleate (0–10%), 2,5-dimercaptothiadiazole (0–5%), benzotriazole (0–5%), dispersed molybdenum disulfide (0–5%), imidazolines (0–10%), and foam inhibitors (0–2%) and the like wherein each weight percent is based on the total weight of the composition.

Fully formulated finished oil compositions of this invention can be formulated from these additive packages upon further blending with an oil of lubricating viscosity. Preferably, the additive package described above is added to an oil of lubricating viscosity in an amount of from about 5 to 15 weight percent to provide for the finished oil composition wherein the weight percent of the additive package is based on the total weight of the composition. More preferably, added along with the oil of lubricating viscosity is a polymethacrylate viscosity index improver which is included at a level of 0–12% and/or a pour point depressant at a level of 0–1%, to form a finished oil wherein the weight percent of each of the viscosity index improver and pour point depressant is based on the total weight of the composition.

A variety of other additives can be present in lubricating oils of the present invention. Those additives include antioxidants, rust inhibitors, corrosion inhibitors, extreme pressure agents, antifoam agents, other viscosity index improvers, other anti-wear agents, and a variety of other well-known additives in the art.

EXAMPLES

The invention will be further illustrated by the following examples, which set forth particularly advantageous method embodiments. While the examples are provided to illustrate the present invention, they are not intended to limit it.

As used herein, the following abbreviations have the following meanings. If not defined, the abbreviation will have its art recognized meaning.

| | |
|---|---|
| cSt = | centistokes |
| g = | gram |
| IR = | infra-red |
| LOB = | low overbased |
| M = | metal |
| mm = | millimeters |
| mL = | milliliter |
| Mn or $M_n$ 32 | number average molecular weight |
| NTU or ntu = | nephelometric turbidity unit |
| PIB = | polyisobutylene |
| PIBS = | polyisobutenyl sulfonate |
| PIBSA = | polyisobutenyl succinic anhydride |
| PSD = | particle size distribution (microns) |
| TBN = | total base number (mgKOH/g) |
| vis = | viscosity |

Example 1

A dispersed alkali metal borate composition is prepared by dehydrating a water-in-oil emulsion of an aqueous solution of an alkali metal hydroxide and boric acid. Preferably a solution is prepared having an alkali metal to boron ratio of 1 to 3.

This solution is then added to a combination of neutral oil, succinic dispersant, and a polyisobutenyl (PIB) sulfonate and mixed to form an emulsion. The resulting emulsion is heated to partially dehydrate it. Reduced pressures can also be used and the temperature set accordingly. During dehydration of the emulsion there is an initial period when water is removed from the emulsion at a rapid rate at a constant temperature for example at about 102° C. After this period, nearly all process water has been eliminated and water removed after this stage is due to the dehydration of the hydrated borate oligomer. Then the temperature slowly increases and the emulsion changes from turbid to clear. As the degree of dehydration and temperature continue to increase, the resulting liquid will again become turbid.

Sodium Borate Dispersions:

A hydrated sodium borate dispersion was prepared by dehydration of an oil-in-water emulsion of an aqueous sodium borate and a succinic dispersant/PIB sulfonate oil solution by heating it to 270° F. for about 3 hours. The aqueous solution was prepared in 2 liter glass beaker by stirring and heating mixtures of: 136.4 g of deionized water, 109.8 g of 99.5% Boric Acid (EMScience), 46.8 g of 50% Sodium Hydroxide in water (VWR), and 0.30 g of 99.5% Sodium Carbonate (EMScience), until the boric acid completely dissolved. Oil-in-water emulsions were made by gradually adding the aqueous phase to an oil phase containing: 136.15 g of Exxon 150 Neutral oil, a group I base oil, 30.25 g of a polyisobutenyl alkenyl succinic anhydride having a molecular weight of about 1100 amu, and 13.25 g of a low overbased calcium polyisobutenyl sulfonate having a TBN of about 14–17 mgKOH/g and wherein the polyisobutenyl moiety has an average molecular weight of about 550 amu, under a vigorous mixing action. A high shear mixer is preferred to form an emulsion or a micro-emulsion.

The emulsion was then dehydrated in a 1-liter stainless steel kettle equipped with a mechanical stirrer, heat mantle, temperature controller, and nitrogen sweep line at a temperature of about 270° F. for a period of about 3 hours to provide a hydrated sodium borate composition having a hydroxyl:boron ratio of about 0.8:1 and a sodium to boron ratio of 3:1.

This composition contains approximately:

45 weight percent of the hydrated sodium borate;

13 weight percent of polyisobutenyl succinic anhydride;

5 weight percent of the calcium polyisobutenyl sulfonate; and the balance being the oil of lubricating viscosity.

Examples 2–4

In addition, using the procedure as described above, three other hydrated sodium borate compositions were prepared. Example 2 used a low overbased calcium polyisobutenyl sulfonate having a TBN of about 14–17 mgKOH/g and wherein the polyisobutenyl moiety has a number average molecular weight of about 1000 amu. Example 3 employed a calcium alkylaromatic sulfonate having a number average molecular weight of about 500 and a TBN of about 28 in place of the calcium polyisobutenyl sulfonate; and Example 4 employed a calcium natural sulfonate with a TBN of about 5, in place of the calcium polyisobutenyl sulfonate. All dispersants in the above examples were employed as a mixture with the same polyisobutenyl succinic anhydride at approximately the same ratio of 2.6:1. The other components in the hydrated sodium borate compositions were employed in approximately the same ratio as Example 1. These results are summarized in Table 1.

TABLE 1

Chemical and Physical Properties of Borate Dispersions

| Ex | Dispersant Mixture PIBSA/Sulfonate | TBN | Turbidity Ntu | OH:B | PSD 90% | PSD 50% |
|---|---|---|---|---|---|---|
| 1 | PIBSA/Calcium polyisobutenyl sulfonate PIBS 550 | 121.5 | 17.4 | 0.81:1 | 0.18 | 0.14 |
| 2 | PIBSA/Calcium polyisobutenyl sulfonate PIBS 1000 | 122.9 | 104 | 0.87:1 | 0.19 | 0.14 |
| 3 | PIBSA/Calcium alkyl-aromatic sulfonate | 123.3 | 84 | 0.72:1 | 0.19 | 0.15 |
| 4 | PIBSA/Natural sulfonate | 123.2 | 104 | 0.79:1 | 0.2 | 0.15 |

In Table 1, the column "PSD 90%" refers to particle size distribution and is a measure of particle size wherein at least 90% of the particles are less than the indicated value, in microns. Similarly, the column "PSD 50%" measures particle size wherein at least 50% of the particles are less than the indicated value, in microns.

Water Tolerance Performance

The water tolerance of a gear oil composition as a function of the dispersant mixture used was evaluated. Hydrated sodium borate compositions prepared similarly to that of Example 1 above were combined with additives to form fully formulated gear oil compositions. These were prepared by taking the borate lubricating compositions of Example 1, and blending at a dosage of about 46% into a typical additive package comprising, ashless dispersant, calcium sulfonate, corrosion inhibitor, EP agent, friction modifier, multifunctional additives, metal deactivator, etc. This additive package was then added at the level of 6.5% to diluent oil to make an 80W90 finished oil formulation. This formulation was then run in the Coordinating Research Counsel L-33 test, to test water tolerance; see U.S. Pat. No. 4,089,790 incorporated herein by reference.

Each of these gear oil formulations were then subjected to water contamination at elevated temperatures using the CRC L-33 test. This test evaluates lubricant performance by exposure of the lubricant to a severe environment. Performance is based upon deposit and rust conditions within the test equipment as well as the condition of the lubricant upon completion of the test. In this test, 1.2 liters of test lubricant are placed in a bench-mounted automotive differential assembly and water, approximately 30 milliliters, is added thus, simulating a type of severe filed service in which corrosion promoting moisture in the form of condensed water vapor has accumulated in the axle assembly. This test has been determined to correlate to field service. The results of this test are found in Table 2 below:

TABLE 2

Water Tolerance Data

| Ex | Dispersant Mixture | L33 Deposits, Area % |
|---|---|---|
| 1 | Polyisobutenyl succinic anhydride/ calcium polyisobutenyl sulfonate PIBS 550 | 1 |
| 2 | Polyisobutenyl succinic anhydride/ calcium polyisobutenyl sulfonate PIBS 1000 | 4.5 |
| 3 | Polyisobutenyl succinic anhydride/ calcium alkyl-aromatic sulfonate | 6 |
| 4 | Polyisobutenyl succinic anhydride/ natural sulfonate | 8.5 |

L33 deposits, area %, are the percentage of the differential housing and parts covered with deposits, as determined by the prescribed method. The results of this test illustrate that water tolerance for the compositions of this invention are significantly superior to those of conventional additive combinations.

From the foregoing description, various modifications and changes in the above described invention will occur to those skilled in the art. All such modifications coming within the scope of the appended claims are intended to be included therein.

What is claimed is:

1. A lubricant composition which comprises:

a base oil of lubricating viscosity;

a dispersed hydrated alkali metal borate; and a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of the polyalkylene succinic anhydride; and b) a metal salt of a polyisobutenyl sulfonate, wherein the polyisobutenyl moiety has a number average molecular weight from about 400 to 1200.

2. The lubricant composition according to claim 1, wherein the dispersed hydrated alkali metal borate is a dispersed hydrated sodium borate.

3. The lubricant composition according to claim 2, wherein the dispersed hydrated alkali metal borate is a dispersed hydrated sodium borate and has a sodium to boron ratio of from about 1:2.75 to about 1:3.25.

4. The lubricant composition according to claim 1, wherein the polyalkylene succinic anhydride is a polyisobutenyl succinic anhydride having a number average molecular weight of at least 500.

5. The lubricant composition according to claim 4, wherein the polyisobutenyl succinic anhydride has a number average molecular weight of from about 900 to about 3000.

6. The lubricant composition according to claim 1, comprising a mixture of polyalkylene succinic anhydrides, said mixture having a low number average molecular weight component of from 500 to below 1000, and having a high number average molecular weight component of from 1000 to about 3000.

7. The lubricant composition according to claim 1, wherein the dispersed hydrated alkali metal borate has a ratio of at least 2:1 relative to the dispersant mixture of polyalkylene succinic dispersant and polyisobutenyl sulfonate.

8. The lubricant composition according to claim 7, wherein the dispersed hydrated alkali metal borate has a ratio of from 2:1 to 10:1 relative to the dispersant mixture.

9. The lubricant composition according to claim 8, wherein the dispersed hydrated alkali metal borate has a ratio of about 5:2 relative to the dispersant mixture.

10. The lubricant composition according to claim 1, wherein the metal salt of a polyisobutenyl sulfonate is an alkali metal or alkaline earth metal salt.

11. The lubricant composition according to claim 10, wherein the metal salt of a polyisobutenyl sulfonate is an alkaline earth metal salt.

12. The lubricant composition according to claim 11, wherein the alkaline earth metal salt is calcium.

13. The lubricant composition according to claim 1, wherein the metal salt of a polyisobutenyl sulfonate has a polyisobutenyl moiety having a number average molecular weight of from about 500 to about 1100.

14. The lubricant composition according to claim 1, which further comprises from about 0.001 moles to about 0.11 moles of a water soluble oxo anion per mole of boron.

15. The lubricant composition according to claim 14, wherein said oxo anion is selected from the group consisting of nitrate, sulfate, carbonate, phosphate, pyrophosphate, silicate, aluminate, germanate, stannate, zincate, plumbate, titanate, molbydate, tungstate, vanadate, niobate, tantalate, uranate, isopolymolybdate, isopolytungstate, heteropolymolybdate, heteropolytungstates, and mixtures thereof.

16. A method for enhancing the water tolerance of lubricant compositions comprising alkali metal borate which method comprises adding an anti-wear effective amount of an alkali metal borate to a base oil of lubricating viscosity in combination with a dispersant effective amount of a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride, and mixtures of one or more polyalkylene succinic anhydrides and one or more non-nitrogen containing derivatives of the polyalkylene succinic anhydride; and b) a metal salt of a polyisobutenyl sulfonate, wherein the polyisobutenyl moiety has a number average molecular weight from about 400 to 1200.

17. A method for preparing a lubricant composition comprising a base oil of lubricating viscosity, a dispersed hydrated alkali metal borate, and a dispersant mixture comprising:

a) a polyalkylene succinic dispersant which is selected from the group consisting of a polyalkylene succinic anhydride, a non-nitrogen containing derivative of the polyalkylene succinic anhydride, mixtures of polyalkylene succinic anhydrides, mixtures of non-nitrogen containing derivatives of the polyalkylene succinic anhydride and mixtures of one or more polyalkylene succinic anhydrides and one or more non-nitrogen containing derivatives of the polyalkylene succinic anhydride; and b) a metal salt of a polyisobutenyl sulfonate, wherein the polyisobutenyl moiety has a number average molecular weight from about 400 to 1200;

which method comprises:

mixing, under agitation, (1) an aqueous solution of boric acid and alkali metal hydroxide, and (2) a diluent oil containing the polyalkylene succinic dispersant and the polyisobutenyl sulfonate; and heating the mixture to remove the water.

18. The method according to claim 17 wherein the dispersed hydrated alkali metal borate is a dispersed hydrated sodium borate.

19. The lubricant composition according to claim 1, wherein the dispersed hydrated alkali metal borate is a dispersed hydrated sodium borate having a hydroxyl to boron ratio of from about 0.8:1 to 1.6:1.

* * * * *